US008911594B2

(12) United States Patent
Gustavsson

(10) Patent No.: US 8,911,594 B2
(45) Date of Patent: Dec. 16, 2014

(54) PAPER MAKING MACHINE, AN EXTENDED NIP ROLL AND A METHOD OF PRODUCING TISSUE PAPER

(71) Applicant: Valmet AB, Sundsvall (SE)

(72) Inventor: Tord Gustavsson, Borgvik (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/357,352

(22) PCT Filed: Dec. 4, 2012

(86) PCT No.: PCT/SE2012/051340

§ 371 (c)(1),
(2), (4) Date: May 9, 2014

(87) PCT Pub. No.: WO2013/085456

PCT Pub. Date: Jun. 13, 2013

(65) Prior Publication Data

US 2014/0284012 A1 Sep. 25, 2014

(30) Foreign Application Priority Data

Dec. 7, 2011 (EP) ..... 11192428

(51) Int. Cl.

| | |
|---|---|
| ***D21F 3/02*** | (2006.01) |
| ***D21F 3/08*** | (2006.01) |
| ***D21F 11/00*** | (2006.01) |
| ***D21F 11/14*** | (2006.01) |

(52) U.S. Cl.

CPC ..... *D21F 3/0209* (2013.01); *D21F 3/0281* (2013.01); *D21F 11/006* (2013.01); *D21F 11/14* (2013.01); *D21F 3/086* (2013.01)

USPC ..... 162/358.3; 162/276; 162/359.1; 162/362

(58) Field of Classification Search

CPC ..... D21F 3/0209; D21F 3/0281; D21F 3/086

USPC ..... 162/358.1, 358.3, 358.5, 359.1, 162/360.2–360.3, 361, 362, 272, 275–276

See application file for complete search history.

(56) References Cited

U.S. PATENT DOCUMENTS 3,981,084 A * 9/1976 Sobota ..... 34/123
4,055,461 A * 10/1977 Turunen ..... 162/290

(Continued)

FOREIGN PATENT DOCUMENTS

EP 1304215 A1 4/2003
EP 2085513 B1 9/2011

(Continued)

OTHER PUBLICATIONS

International Searching Authority, International Search Report for International Application No. PCT/SE2012/051340, mailed Mar. 18, 2013, 5 pages, Swedish Patent and Registration Office, Sweden.

(Continued)

*Primary Examiner* — Jose Fortuna
(74) *Attorney, Agent, or Firm* — Alston & Bird LLP

(57) ABSTRACT

The invention relates to an arrangement arranged to introduce a three-dimensional structure in a paper during production of said paper in a paper making machine (1). The arrangement comprises a heat roll (14) arranged to dry a wet paper web and an extended nip roll (12) arranged to form a transfer nip (TN) with said heat roll (14). The extended nip roll (12) is provided with a flexible jacket (17) arranged around the circumferential area of said extended nip roll (12). An external surface of said flexible jacket (17) is provided with a textured portion (15) and when the wet paper web passes the transfer nip between said extended nip roll (12) and said heat roll (14), said textured portion (15) of the external surface of the flexible jacket (17) will impart a three-dimensional texture to the paper web.

12 Claims, 2 Drawing Sheets

(56) References Cited

U.S. PATENT DOCUMENTS

| | | | | |
|---|---|---|---|---|
| 4,144,124 | A * | 3/1979 | Turunen et al. | 162/290 |
| 4,225,382 | A | 9/1980 | Kearney et al. | |
| 4,309,246 | A * | 1/1982 | Hulit et al. | 162/113 |
| 4,507,173 | A | 3/1985 | Klowak et al. | |
| 4,625,376 | A | 12/1986 | Schiel et al. | |
| 5,098,523 | A | 3/1992 | Ilmarinen et al. | |
| 5,126,015 | A * | 6/1992 | Pounder | 162/206 |
| 5,393,384 | A | 2/1995 | Steiner et al. | |
| 5,670,023 | A * | 9/1997 | Steiner et al. | 162/359.1 |
| 5,738,760 | A | 4/1998 | Svanqvist et al. | |
| 5,741,402 | A | 4/1998 | Trokhan et al. | |
| 5,875,990 | A | 3/1999 | Svanqvist et al. | |
| 5,901,918 | A | 5/1999 | Klerelid et al. | |
| 6,030,500 | A | 2/2000 | Haraldsson et al. | |
| 6,036,909 | A * | 3/2000 | Baum | 264/280 |
| 6,165,324 | A | 12/2000 | Linden | |
| 6,176,898 | B1 | 1/2001 | Courtney et al. | |
| 6,189,442 | B1 | 2/2001 | Honkalampi et al. | |
| 6,395,136 | B1 * | 5/2002 | Andersson et al. | 162/358.5 |
| 6,547,924 | B2 | 4/2003 | Klerelid et al. | |
| 6,790,315 | B2 * | 9/2004 | Klerelid | 162/117 |
| 7,527,708 | B2 | 5/2009 | Gustavsson | |
| 7,662,260 | B2 * | 2/2010 | Thoroe-Scherb et al. | 162/205 |
| 7,811,418 | B2 | 10/2010 | Klerelid et al. | |
| 8,002,950 | B2 | 8/2011 | Quigley | |
| 2001/0035103 | A1 * | 11/2001 | Thoroe Scherb et al. | 100/37 |
| 2002/0052160 | A1 * | 5/2002 | Hill et al. | 442/32 |
| 2008/0283208 | A1 * | 11/2008 | Norrman et al. | 162/202 |
| 2009/0173465 | A1 * | 7/2009 | Gustavsson | 162/205 |
| 2014/0284012 | A1 * | 9/2014 | Gustavsson | 162/206 |

FOREIGN PATENT DOCUMENTS

| | | | |
|---|---|---|---|
| WO | WO 99/40255 | A1 | 8/1999 |
| WO | WO 02/50372 | A1 | 6/2002 |

OTHER PUBLICATIONS

International Searching Authority, Written Opinion for International Application No. PCT/SE2012/051340, mailed Mar. 18, 2013, 5 pages, Swedish Patent and Registration Office, Sweden.

* cited by examiner

PAPER MAKING MACHINE, AN EXTENDED NIP ROLL AND A METHOD OF PRODUCING TISSUE PAPER

CROSS REFERENCE TO RELATED APPLICATIONS

This application is a National Stage Application, filed under 35 U.S.C. §371, of International Application No. PCT/SE2012/051340, filed Dec. 4, 2012, which claims priority to European Application No. 11192428.8, filed Dec. 7, 2011; the contents of both of which are hereby incorporated by reference in their entirety.

BACKGROUND

1. Related Field

The present invention relates to a paper making machine for producing tissue paper. The invention also relates to a method of producing tissue paper and to an extended nip roll which is suitable for use in the inventive method.

2. Description of Related Art

A paper making machine for the production of tissue paper is known from U.S. Pat. No. 5,393,384. The paper machine shown therein has a belt impermeable to water which runs in a loop through an extended press nip formed by a shoe press and a counter roll. A press felt is conveyed through the press nip. In one embodiment, a shoe press has been placed such that the press shoe is capable of acting on the tissue drying cylinder. It is stated that the drying effect of the shoe press generates a considerably higher degree of drying than a corresponding roll press and that this, in the conjunction with a nonabsorbent belt which avoids remoistening of the web results in considerably increased drying capacities of a press unit.

Another paper making machine for soft paper such as tissue is disclosed in U.S. Pat. No. 6,547,924. The paper making machine shown in that patent also uses a substantially impermeable belt but this belt is a texturing belt which has a web-contacting surface defining a multitude of regularly distributed depressions and surface portions located between the depressions. The belt is used for the purpose of texturing a relief pattern in a fibrous web in order to increase its bulk. The substantially impermeable belt runs in a loop through a press with a shoe press roll and a counter roll and around a transfer roll that forms a transfer nip with a Yankee dryer.

Yet another paper making machine is shown in U.S. Pat. No. 7,811,418. The paper making machine shown in that patent uses a transfer belt that may have depressions and a permeable structuring fabric which is arranged to transfer the wet paper web to a drying cylinder. In embodiments described in that document, a shoe press is used in which the transfer belt passes through a press nip between a shoe press roll and a counter roll.

The above mentioned patents include a large number of components. It is desirable to reduce the number of components used in the machine.

U.S. Pat. No. 4,144,124 discloses a machine for manufacturing paper such a tissue paper. The machine disclosed in that patent comprises a twin-wire former and a press nip between an inner and an outer press roll. The upper or outer press roll is a suction roll which, together with a Yankee cylinder forms a second nip. An endless fabric such as a wire suitable for pattern embossing is may be used and is said to produce impressions in the paper at the press nips. This machine can use uses fewer rolls in the press section since the suction roll is used two nips, one nip with the so called "inner roll" and one nip with the Yankee cylinder.

It is an object of the present invention to provide a paper making machine for tissue paper which has a simple design and few parts and which is capable of producing a tissue paper web that has a high bulk. These and other objects are achieved by means of the present invention as will be explained.

BRIEF SUMMARY

The invention relates to a paper making machine for making paper. The inventive machine is arranged to introduce a three-dimensional structure in a paper during production of said paper in a paper making machine. The paper making machine comprises a heat roll arranged to dry a wet paper web and an extended nip roll arranged to form a transfer nip with said heat roll. In the context of this patent application, the term "heat roll" should be understood as a roll that is heated or arranged to be heated. The heat roll may be a roll that is provided with external means for heating such as, for example, a burner or an IR heater arranged adjacent an outer surface of the heat roll to heat the heat roll. The heat roll could also be arranged to be heated from the inside of the heat roll by, for example, a hot gas or fluid. For example, it could be a Yankee cylinder which is arranged to be internally heated by hot steam. Said extended nip roll is provided with a flexible jacket arranged around the circumferential area of said extended nip roll and wherein an external surface of said flexible jacket is provided with a textured portion. When the wet paper web passes the transfer nip between said extended nip roll and said heat roll, said textured portion of the external surface of the flexible jacket will impart a three-dimensional texture to said paper web, i.e. form a three-dimensional pattern in the paper web.

The inventive paper making machine suitably also comprises a former in which the fibrous paper web may be formed. The former has a forming roll, a forming fabric and a felt. The machine may optionally comprise a second press member, e.g. a counter roll for the extended nip roll. The counter roll for the extended nip roll may be arranged to form a dewatering nip with the extended nip roll and the felt (i.e. the same felt as is used in the former) may optionally be arranged to pass through the dewatering nip. According to the invention, the extended nip roll has a flexible jacket that forms a loop and a support body within the loop of the flexible jacket. The support body can be caused to press the flexible jacket radially outwards. Moreover, the support body is placed opposite the heat roll, e.g. a drying cylinder, such that the support body can press the flexible jacket towards the drying cylinder to close the transfer nip. The extended nip roll is preferably movable in relation to the drying cylinder such that the distance between the drying cylinder and the extended nip roll can be increased in a separating movement or decreased in a closing movement. The paper making machine may further comprise a mechanical stop arranged to halt the closing movement.

In embodiments of the invention, said textured portion extends along substantially the whole length of said flexible jacket in a cross-machine direction and said textured portion covers at least 60%, preferably at least 80% and more preferred substantially the whole of the external surface of said flexible jacket. A cleaning device may preferably be arranged to clean the outer, external surface of the flexible jacket or at least the textured portion thereof.

In embodiments of the invention, said extended nip roll comprises at least one support body, where said support body may be a flexible support body which comprises an internal cavity that can be pressurized internally by means of pressurized fluid.

In other embodiments of the invention, said support body comprises at least one shoe with a concave surface, said concave surface faces outwards such that it can cooperate with the convex surface of said heat roll.

In still other embodiments, said body support may comprise both a flexible support body and a shoe.

In embodiments of the invention, the flexible support body comprises or is supported by at least one flexible hose extending in a cross machine direction and connected to a source of pressurized fluid such that pressurization of the at least one flexible hose will cause the flexible support body to either expand or move radially outwards.

Within the loop of the flexible jacket, the extended nip roll may optionally also comprise a second support body, e.g. a rigid concave shoe where the concave surface is facing the drying cylinder or a flexible support body with an internal cavity, that is placed opposite the counter roll for the extended nip roll to cooperate with the counter roll for the extended nip roll to form the dewatering nip.

When the paper making machine is provided with an arrangement according to the invention, the invention can also be described in terms of a method of producing tissue paper by such a machine. The method comprises providing the wet paper web with a three-dimensional structure formed by a textured portion provided on an external surface of said flexible jacket forming a loop surrounding said extended nip roll.

By using one and the same roll to form both a transfer nip TN and to form a textured structure of the paper web (and possibly also to form a press nip PN), fewer parts are necessary.

The invention also relates to an extended nip roll that comprises a flexible jacket that forms a loop around at least one support body such as a concave shoe or a flexible support body. The extended nip roll has means for causing the support body to press radially outwards against the inner surface of the flexible jacket. According to the invention, the flexible jacket has an external surface of which at least a portion is textured such that it can impart a three-dimensional structure to a paper web that passes a nip formed between the extended nip roll and a counter element.

DETAILED DESCRIPTION OF VARIOUS EMBODIMENTS

Figure 1:
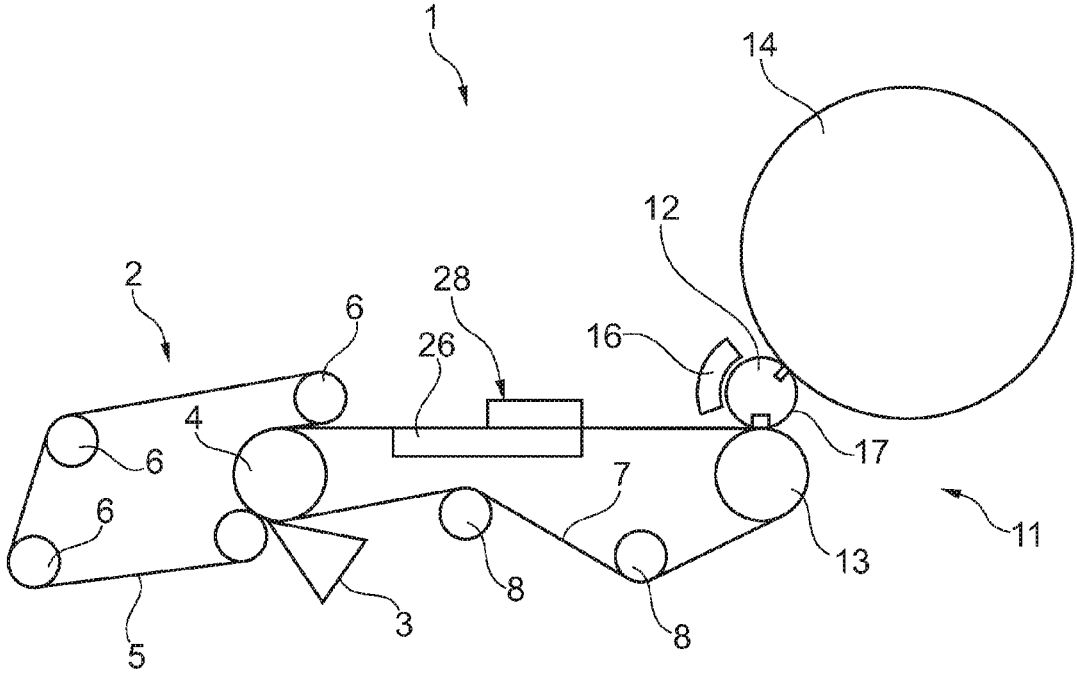
FIG. 1 shows a layout of a paper making machine according to one embodiment.

With reference to FIG. 1, the invention may be described in terms of a paper making machine 1 for making paper, in particular tissue paper. As used herein, the term "tissue paper" relates to paper having a relatively low basis weight. In most cases, this means a basis weight in the range of 10 g/m$^2$-50 g/m$^2$ although examples of tissue paper webs are known where the basis weight may lie outside this range. Unlike paperboard, tissue paper does not have to be stiff and tissue can therefore have a lower basis weight. In most cases, the basis weight for tissue paper may lie in the range of 15 g/m$^2$-40 g/m$^2$ and typical values may lie in the range of 15 g/m$^2$-30 g/m$^2$ or 20 g/m$^2$-30 g/m$^2$. Such paper can be used as, for example, facial tissue, toilet paper or absorbent paper towel (e.g. kitchen towel). The machine according to the invention comprises a former 2 in which a wet fibrous web may be formed. As can be seen in FIG. 1, the former 2 has a forming roll 4, a forming fabric 5 and a felt 7. The forming fabric 5 is suitably a permeable wire. The forming fabric 5 is guided in a loop by guide rolls 6 and the felt 7 is guided in a loop partially by guide rolls 8 but also by the forming roll 4 and by a press member 13. The former 2 also has a head box 3 arranged to inject stock in a gap formed between the forming fabric 5 and the felt 7 as is known in the art. The head box 3 may optionally be a multilayer head box, for example a head box of the kind disclosed in U.S. Pat. No. 6,165,324. Optionally, the head box 3 may be designed as a dilution head box, for example in the way disclosed in U.S. Pat. No. 6,030,500. In embodiments of the invention, the head box 3 may be a multilayer head box which is also designed to be a dilution head box. One or several felt dewatering devices 26 may be arranged to remove water from the felt 7 as is known in the art to which the invention pertains. The dewatering device 26 may be, for example, a Uhle box.

Figure 3:
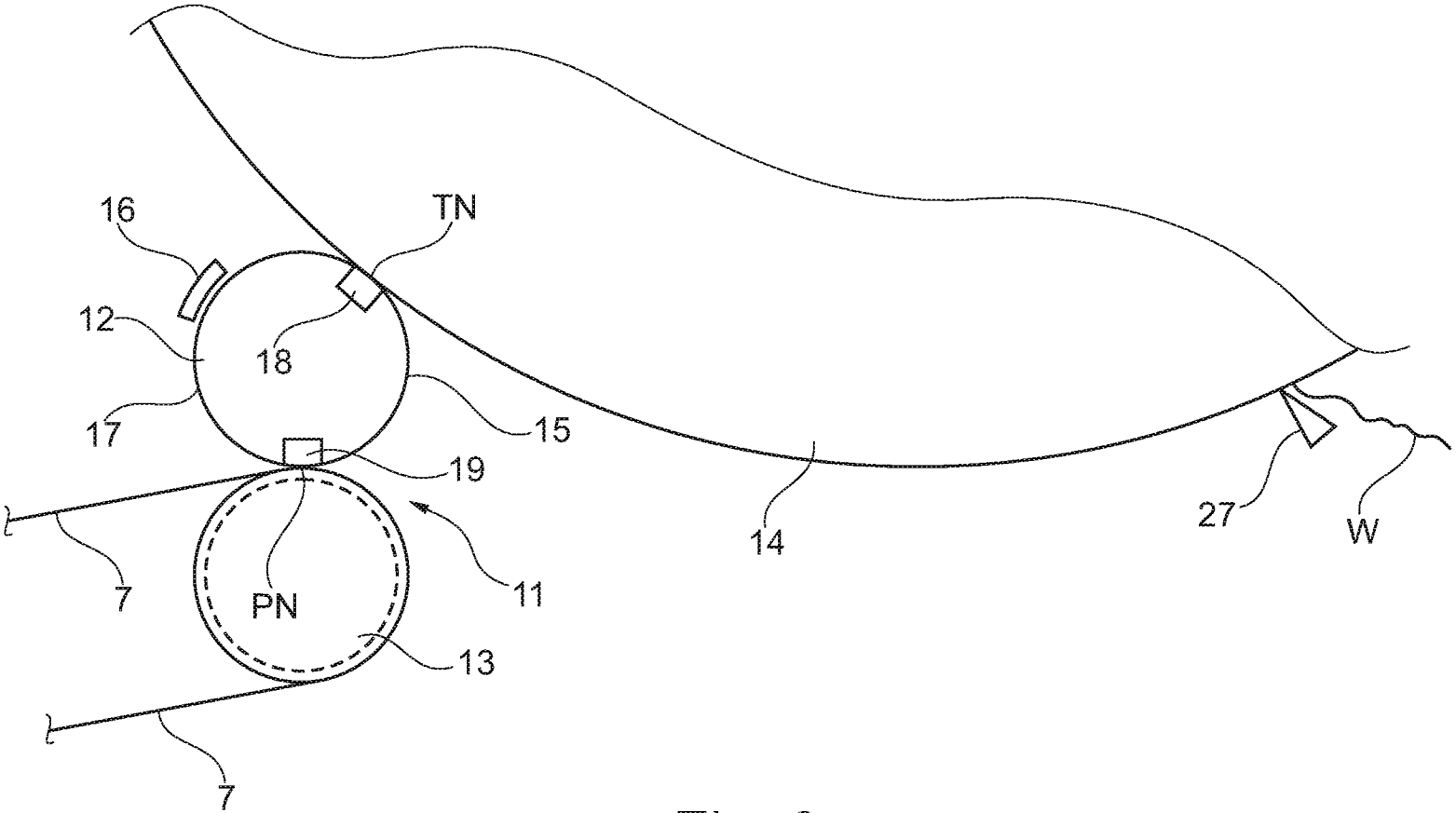
FIG. 3 is a schematic representation of a detail of a paper making machine as shown in FIG. 1.

With reference to FIG. 1 and FIG. 3, the machine 1 may also comprise a press 11 with an extended nip roll 12 and an optional counter roll 13 for the extended nip roll. The counter roll 13 for the extended nip roll is preferably arranged to form a dewatering nip PN with the extended nip roll 12 (see also FIG. 3). The felt 7 is arranged to pass through the dewatering nip PN. As can be seen in FIG. 1 the felt 7 forms a loop around the second dewatering member 13. In the dewatering nip PN, water is pressed from the wet paper web and absorbed by the felt 7. One or several further felt dewatering devices, for example Uhle boxes, may be arranged to dewater the felt 7 while the felt runs from the press 11 back to the forming roll (these further dewatering devices are not shown in FIG. 1).

The machine also comprises a heat roll 14, which can act as a drying cylinder. The drying cylinder may suitably be a Yankee drying cylinder which is internally heated by steam. The drying cylinder 14 may also be heated by other means, for example by infrared heaters, hot oil or by induction (not shown). The drying cylinder 14 is arranged to form a transfer nip TN with the extended nip roll 12 (see FIG. 3). According to the invention, the extended nip roll 12 has a flexible jacket 17 that forms a loop and a support body 18 within the loop of the flexible jacket 17, as is also shown in FIG. 3. The support body 18 may preferably be a flexible support body with an internal cavity that can be filled with pressurized fluid such that the support body 18 expands. There may also be provided a cleaning device 16 in vicinity of the flexible jacket 17 for of cleaning the surface of the flexible jacket 17, which surface also includes a textured portion 15, during operation of the machine.

Figure 2:
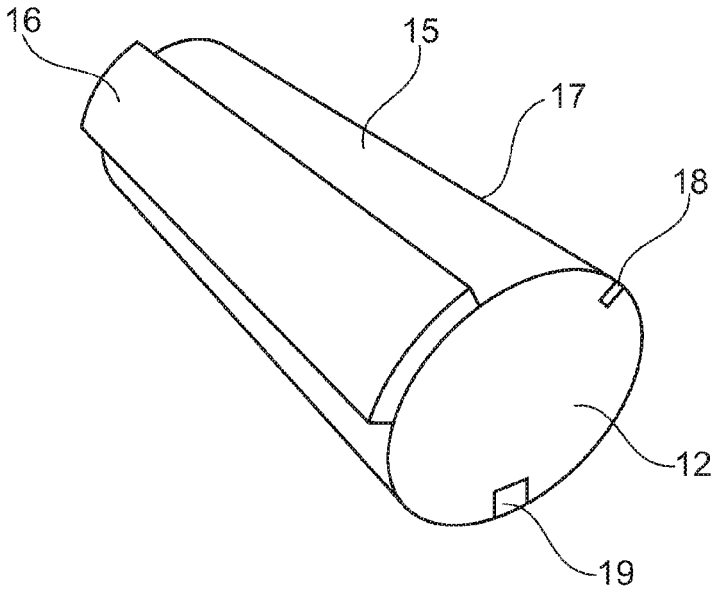
FIG. 2 is a schematic representation of a extended nip roll according to the embodiment as shown in FIG. 1.

In FIG. 2, a part of the inventive machine is shown in detail. The extended nip roll 12 comprises the flexible jacket 17 comprising the textured portion 15. Said flexible jacket 17 loops the external width of the extended nip roll 12 in its cross-machine direction. The three-dimensional texture (or structure) of the textured portion is directed outwardly from the extended nip roll 12 towards the paper web such that it can act on the paper web and impart a three-dimensional structure of the wet fibrous paper web.

With reference to FIG. 1 and FIG. 2, it should be understood that the support body 18 is placed opposite the heat roll 14 such that it can cooperate with the heat roll 14 to form the transfer nip TN. The support body 18 cooperates with the heat roll 14 in the way that, when the support body is caused to expand or move radially outwards against the inner surface of the flexible jacket 17, the flexible jacket 17 is thereby caused to move radially outwards such that the flexible jacket 17 is pressed against the heat roll 14.

Preferably, the extended nip roll 12 has an additional support body 19 as indicated in FIGS. 1-3. It should also be understood that the support body 19 which is placed opposite the counter roll 13 in FIG. 1 can cooperate with the counter roll 13 to form a dewatering nip PN when the support body 19 is caused to expand or move radially outwards towards the counter roll 13 such that the flexible jacket 17 is pressed against the counter roll 13 and the felt 7 that runs between the flexible jacket 17 and the counter roll 13.

It should be understood that the flexible jacket 17 and its textured portion 15 may be made of a material that is compressible to a certain degree. The material(s) used may be heat sensitive. This is especially the case when the flexible jacket 17 contains polymer materials. The flexible jacket 17 is preferably made of polyurethane or it comprises polyurethane material or materials similar to polyurethane. It is however understood that other materials may possibly be suitable. The flexible jacket 17 may optionally be made of more than one material. The flexible jacket 17 is preferably elastically compressible to some extent such that the thickness of the flexible jacket decreases temporarily as the flexible jacket 17 passes through a press nip. When the paper web passes through the dewatering nip PN, compression of the flexible jacket 17 makes it easier for the paper web to follow the flexible jacket 17 instead of the felt 7.

Said textured portion 15 preferably extends around the entire circumference of the flexible jacket 17 although embodiments are conceivable in which it extends around only a part of the entire circumference, for example along an arc covering 350° of the circumference instead of a full 360°. In the cross machine direction, the textured portion preferably extends along the major part the whole length of the flexible jacket 17. Preferably, the textured portion 15 covers at least 60%, preferably at least 80% and more preferred substantially the whole area of the external surface of said flexible jacket 17. The length of said flexible jacket 17 in the cross machine direction is substantially the same as the length of the extended nip roll in the cross machine direction and, hence, the textured portion covers substantially the whole of the outer, external surface of the extended nip roll 12.

The textured portion 15 (i.e. a portion having a structured surface) has raised surface portions (knuckles) and depressions.

In embodiments of the invention, the textured portion 15 may have a surface which is shaped as the texturing belt described in U.S. Pat. No. 6,547,924. That patent describes a substantially impermeable texturing belt having a web-contacting side defining a multitude of regularly distributed depressions and surface portions located between the depressions. The substantially impermeable belt is arranged to pass with the paper web through a press such that the depressions of the web-contacting surface initially form in the paper web an equivalent textured pattern having thicker and thinner portions. The web-contacting surface may have a structure comprising depressions and surface portions therebetween. The surface portions may have an arched or convex shape. The arched or convex surface portions may comprise a plurality of knuckles formed by fabric threads extending in one and the same direction and which are uniformly distributed in a number of 25-150 knuckles per $cm^2$. The textured portion of the flexible jacket of the present invention may also be designed like that.

Embodiments are conceivable in which the knuckles (raised portions) of the flexible jacket 17 are not uniformly distributed but distributed in an irregular way.

The knuckles (or other raised surfaces) of the flexible jacket 17 may preferably (but not necessarily) be machine-direction oriented.

In embodiments of the invention, the textured portion may also have fewer than 25 knuckles or other raised surfaces per square centimeter. For example, it could have 10-24 knuckles per square centimeter. However, fewer knuckles per square centimeter will have the result that the ability of the flexible jacket to impart a three-dimensional structure on the paper web becomes smaller. Therefore, it is preferred that the textured portion should have at least 25 knuckles per square centimeter.

It should be understood that the flexible jacket 17 of the present invention needs to be impermeable to lubricants used inside the flexible jacket to reduce friction between the flexible jacket and the support body.

In embodiments of the invention the textured portion 15 is an integral part of the flexible jacket 17, i.e. substantially the whole of the external, circumferential surface of the flexible jacket 17 is provided with a texture. Said texture may be applied by e.g. gravure or embossing of the surface of the flexible jacket 17. Alternatively, the textured portion 15 may be formed by a separate fabric that is bounded to the flexible jacket 17.

The structure of the textured portion 15 may for example be of the same design as disclosed in U.S. Pat. No. 6,547,924. Another example of a possible design is disclosed in U.S. Pat. No. 8,002,950. It is however understood that the structure of the textured portion 15 is not limited to said examples but may have other possible designs for forming other three-dimensional structures of the paper while still be within the scope of the present invention.

By means of a textured portion 15 it is possible to enhance properties which are important particularly in tissue paper, so that it is possible to provide the tissue paper with superior bulk, strength and absorptivity. The use of a textured portion 15 may improve/increase the bulk of the paper web by imparting a three-dimensional structure to the paper web as the web passes through the pressure nip PN and/or the transfer nip TN. As a result of the increased bulk the absorptivity of the paper is improved and that is very beneficial for tissue paper.

The cleaning device 16 may be any kind of cleaning device appropriate for cleaning of the external surface of the flexible jacket 17. For example the cleaning device may comprise brushes arranged to brush up the surface of the flexible jacket 17 or means for providing pressurized air via nozzles for blowing off the surface. Another alternative may be some sort of vacuum cleaning where the cleaner has one or several appropriately designed nozzles for uptake of impurities along the whole length of the surface of the flexible jacket 17. Still another alternative may be cleaning with appropriate cleaning fluid where said fluid may be added e.g. by spraying and where brushes wipes off the fluid containing the impurities and/or suction nozzles suck up said fluid. The invention is not limited to a certain choice of cleaning device but many different kinds of cleaning devices may be suitable. Said impurities are most often dust comprising cellulose fibers etc released from the paper web but may also comprise different impurities from the surroundings of the paper machine. The cleaning device is appropriately arranged e.g. by being fixedly mounted to appropriate parts of the paper machine. It may in some embodiments be preferred that the cleaning device is arranged such that it is possible to move the cleaning device away from the vicinity of the flexible jacket 17 and its textured portion 15 if a need arises to being able to repair the extended nip roll 12 or to replace a worn out press member.

Normally, extended nip rolls comprise only one support body such as a concave shoe. However, the extended nip roll 12 of the present invention preferably comprises two support bodies within the loop of the flexible jacket 17. As can be seen more clearly in FIG. 3, the extended nip roll 12 may comprise two support bodies 18, 19, preferably flexible support bodies, in which case a first support body 18 is arranged to act against the drying cylinder 14 and a second support body 19 is arranged to act against the counter roll 13 for the extended nip roll. Each support body 18, 19 can be caused to press the flexible jacket 17 radially outwards. If the support body is flexible, this should be understood as meaning that, at least to some extent, it can adapt its shape to follow the contour of an opposing element such as the drying cylinder 14 or the counter roll 13 for the extended nip roll. The counter roll for the extended nip roll 13 is suitably a deflection controlled roll (a deflection compensated roll) such as the SymRoll roll from Metso Paper. In advantageous embodiments of the invention, the counter roll 13 for the extended nip roll may be provided with grooves (not shown). The use of a grooved roll in this position improves dewatering. In other embodiments, the counter roll 13 for the extended nip roll may be a press roll with a smooth surface, for example a roll with a cover, e.g. an elastic cover such as a cover of rubber or a material with properties similar to rubber. The cover could also be a ceramic cover. The counter roll 13 may also be a roll without a cover. In some embodiments also the counter roll 13 may be provided with a textured surface structure and it is also possible that textured surface of said counter roll 13 is further provided with grooves.

The extended nip roll 12 and the flexible support body 18 (and optionally also the second flexible support body 19) may be designed in a way shown in, for example, U.S. Pat. No. 7,527,708, the disclosure of which is hereby incorporated by reference. As can be seen in FIG. 3, the flexible support body 18 is placed within the loop of a flexible jacket 17 that can be made wholly or in part of, for example, polyurethane or a material with properties similar to polyurethane. The flexible jacket 17 may thus comprise polyurethane but possibly also other components which are suitably for being textured. The flexible support body 18 may be formed by or comprise a body that can be described as a flexible hose with an internal cavity that can be pressurized internally by means of pressurized fluid that is caused to flow into the internal cavity from a source of pressurized fluid that is connected to the internal cavity, as disclosed in U.S. Pat. No. 7,527,708. The source of pressurized fluid may be controlled by a control device. The control device may be, for example, a computer. The support bodies 18, 19 may be connected to the same source of pressurized fluid. It should be understood that each flexible support body 18, 19 may be connected to its own source of pressurized fluid. The flexible support body 18 may be placed in a channel of a holder (not shown). It should be understood that the support body 18 may be sealed at its axial ends. The flexible support body 18 is preferably made of an elastic material such that either the entire support body 18 or at least a part of is made of an elastic material such that the flexible support body is elastically deformable. The support body 18 can be made of, for example, plastic or rubber material such as polymers, possibly reinforced polymers. If pressurized fluid is fed into the internal cavity, the flexible support body 18 will expand radially outwards. It should be understood that the flexible jacket 17 runs over the flexible support body 18. When the flexible support body 18 expands radially outwards, it will press against the flexible jacket 17 such that also the flexible jacket 17 is pressed outwards. It should be understood that the flexible support body 18 which has an inner cavity as described above also extends in the cross machine direction.

The flexible support body 18 must not necessarily be shaped as in U.S. Pat. No. 7,527,708. Another kind of flexible support body arrangement is shown in European patent EP 2085513 B1 and such an arrangement may be used also in the present invention. In such embodiments the flexible support body 18 is a thin shoe with a concave surface. The concave surface faces outwards such that it can cooperate with a convex counter element such as a roll in order to form a nip with the convex counter element. The thin shoe that forms the flexible support body may be made of, for example, aluminum, and be sufficiently thin to allow the shoe to adapt to a large extent to the contour of a counter roll (such as a Yankee drying cylinder). The thin shoe is supported by one, two or more flexible hoses that can be made of an elastic material or a material that is only flexible but not elastic. The flexible hose or flexible hoses extend in the cross machine direction and are connected to a source of pressurized fluid in the same way as described with reference to FIG. 2 and FIG. 3. In some embodiments, a further thin sheet and a number of separate intermediate pieces may optionally be placed between the flexible support body 18 and the flexible hose(s). The thin sheet may serve to protect the flexible hoses from the intermediate pieces. The intermediate pieces can be capable of moving relative to each other in the radial direction (i.e. substantially in the press plane). Thereby, the flexible support body 18 can more easily adapt to the shape of a counter element such as a Yankee cylinder 14. If the flexible hose(s) is (are) filled with pressurized fluid, this may cause the flexible hose(s) to expand and thereby cause the flexible support body 18 to move outwards against the inner surface of the flexible jacket 17 such that also the flexible jacket 17 is pressed radially outwards.

The flexible support body 18 may be described as comprising or being supported by at least one flexible hose extending in the cross machine direction and connected to a source of pressurized fluid such that pressurization of the at least one flexible hose will cause the flexible support body 18 to either expand or move radially outwards.

It should be understood that, regardless of how the flexible support body is designed and arranged, the extended nip roll may have an internal lubrication arrangement (not shown) to supply lubrication fluid (e.g. oil) to the inner surface of the flexible jacket 17 such that there will be a thin film of lubrication fluid between the flexible support body 18 (or support element 18) and the inner surface of the flexible jacket 17. Thereby, friction between the flexible jacket 17 and the flexible support body may be reduced. Various arrangements for supplying a lubricant in an extended nip press are known in the art.

The first flexible support body 18 is further placed opposite the drying cylinder 14 such that the flexible support body 18 can press the flexible jacket 17 towards the drying cylinder 14. Thereby, the flexible support body 18 can close the transfer nip TN.

It should be understood that, instead of an extended nip roll 12 with a flexible support body, the support element(s) of the extended nip roll 12 could comprise one or several conventional concave shoes that are substantially rigid. The extended nip roll 12 could also have one flexible support element while the other support element is rigid shoe having an outer profile which is concave and faces the counter roll (for example a Yankee cylinder).

As can be seen in FIG. 3, a doctor blade 27 has been arranged to crepe the paper web W from the drying cylinder 14. The inventor has discovered that the use of a flexible support body in the transfer nip has the surprising effect that the bulk of the paper web is improved. Since bulk is often a desired property for tissue paper, this is of great practical value. Without wishing to be bound by theory, it is believed by the inventors that the use of a flexible support body causes the paper web to adhere stronger to the surface of the drying cylinder. The following creping operation by the doctor blade 27 may then have a greater effect on the paper such that bulk is increased.

In FIG. 3, it can further be seen that, within the loop of the flexible jacket 17, the extended nip roll 12 may also comprise a second flexible support body 19. The second flexible support body 19 is placed opposite the counter roll for the extended nip roll 13 to cooperate with the counter roll for the extended nip roll 13 in order to form the dewatering nip PN.

Instead of the second flexible support body 19, a substantially rigid concave shoe as in a conventional shoe press may also be used for the dewatering nip PN. The counter roll for the extended nip roll 13 may be a roll with grooves. It may also be, for example, a suction roll or a deflection-compensated roll.

If a rigid concave shoe is used instead of a flexible support element, the extended nip roll will be provided with means such as hydraulic cylinders for causing the rigid concave shoe to be pressed radially outwards such that the flexible belt 17 is also pressed outwards by the shoe to close a nip such as the transfer nip TN or the dewatering nip PN. The hydraulic cylinders may be arranged on a support beam which extends in the cross machine direction and is looped by the flexible belt 17. The concave face of the shoe would be facing radially outwards such that the shoe can cooperate with the convex surface of a counter roll to form a nip.

When the support body 18, 19 is a flexible support body 18, 19, the means for causing the flexible support body to be pressed radially outwards may be formed by an internal cavity in the support body itself which cavity can be filled with a pressurized liquid such that the flexible support body expands radially outwards against an inner surface of the flexible jacket 17 such that the flexible jacket 17 is thereby pressed outwards against a counter element such as a Yankee cylinder or a counter roll 13.

When the support body 18, 19 is a flexible support body 18, 19, the means for causing the flexible support body to be pressed radially outwards may also be formed by one or several flexible hoses on which the support body is resting, for example as disclosed in EP 2085513 B1.

The extended nip roll 12 is preferably an enclosed roll where the axial ends of the flexible jacket 17 are fastened to end walls by means of fastening means, for example in the way disclosed in U.S. Pat. Nos. 5,098,523 or 4,625,376. The inner space within the flexible jacket 17 can optionally be arranged to be supplied with pressurized air or gas such that the flexible jacket is inflated and under pressure from inside. The extended nip roll 12 may also be provided with means for continuous supply of fresh lubrication fluid (e.g. oil) for the support body/bodies and means for removing used lubrication oil.

Optionally, the extended nip roll 12 may be provided with means for driving the flexible jacket before the flexible jacket makes contact with any counter element such as the Yankee cylinder. Such means for deriving the flexible jacket are disclosed in U.S. Pat. No. 6,189,442 and could be used also for the extended nip roll according to the present invention. Such an arrangement could protect the flexible jacket 17 from heat.

When the dewatering nip PN is formed with a flexible support body 19, the dewatering nip PN may suitably be operated at a linear load in the range of 100 kN/m-600 kN/m and a peak pressure of 6 MPa. In one embodiment contemplated by the inventors, the dewatering nip PN formed by a flexible support body may have a nip length of 125 mm-140 mm and a linear load of 150 kN/m.

When the dewatering nip is formed with a rigid shoe (i.e. a conventional metal shoe that may have a concave surface facing to opposite press member), the machine direction length of such a rigid shoe may be in the range of 50 mm-150 mm while the linear load of the dewatering nip in such a case may be in the range of 200 kN/m-1000 kN/m, preferably 300 kN/m-1000 kN/m. In many realistic embodiments, the linear load may be in the range of 400 kN/m-600 kN/m when a rigid concave shoe (e.g. a steel shoe) is used in the dewatering nip PN. This may give an adequate dewatering without causing unnecessary bulk reduction of the produced paper.

The transfer nip TN may be operated at a linear load which is, for example, in the range of 50 kN/m-100 kN/m but it is believed by the inventors that higher linear loads (and higher pressure levels) in the transfer nip TN may actually have the benefit of improving the bulk since a higher linear load can cause the web W to adhere stronger to the surface of the drying cylinder 14. When the flexible support body 18 in the transfer nip TN is formed by a flexible hose with an internal cavity, the length of the transfer nip TN in the machine direction may suitably be in the range of 30 mm-100 mm and preferably 30 mm-80 mm. It is believed by the inventors that a length in this range is advantageous for achieving good adhesion of the web to the drying cylinder while avoiding unnecessarily large dimensions of the components used. A suitable highest pressure in the transfer nip TN may be in the range of 1 MPa-3 MPa. In one embodiment contemplated by the inventors, the highest pressure in the transfer nip TN may be 2 MPa or about 2 MPa. However, it is believed by the inventors that higher peak pressures could result in even better adhesion of the web to the surface of the drying cylinder 14. Therefore, peak pressures up to 6 MPa may be tested or possibly even higher peak pressures.

In some cases, the flexible support body 18 that is used for the transfer nip TN may possibly have a longer nip length than 80 mm. In such embodiments, the flexible support body 18 may have several chambers that may be individually pressurized as disclosed in U.S. Pat. No. 7,527,708 (such an embodiment is shown in FIG. 12 of U.S. Pat. No. 7,527,708). In such embodiments, nip length in the transfer nip TN may be in the range of 50 mm-150 mm. For such longer transfer nips, the linear load can be made higher.

By using a textured flexible jacket 17 in the extended nip roll 12, no separate texturing belt is needed.

Also by using the same felt in the forming section and the dewatering nip PN, the number of components can be reduced.

However, it should be understood that the felt used in the forming section need not be identical to the felt used in the dewatering nip.

The extended nip roll 12 may be movable away from and toward a mechanical stop which defines a working position (not shown in the figures). Such a mechanical stop may be arranged on each side of the machine (i.e. both the tender side and the drive side) and be arranged to cooperate with bearing housings of the extended nip roll such that movement of the extended nip roll towards its operating position comes to a halt when the bearing housings meet the mechanical stop or mechanical stops.

The use of such a mechanical stop or mechanical stops entails the advantage that the working position of the extended nip roll can be well-defined even when it is moveable towards and away from its operating position. When the extended nip roll 12 can be brought to a well-defined position near the drying cylinder 14 before the flexible support body 18 is activated, the risk that the pressure in the flexible hose of the support body 18 should become too high before the nip is properly closed can be avoided.

It should be understood that embodiments are conceivable in which the extended nip roll is not movable but instead placed in a fixed position.

The use of a flexible support body 18 in the transfer nip TN entails the advantage that the bulk of the paper web can be improved.

The inventive method is now to be described. In the forming section, an embryonic paper web is formed when stock is injected by the head box 3 into the gap between the forming fabric 5 and the felt 7. In the embodiment shown in FIG. 1, the newly formed paper web will be passed on the felt 7 to the press nip PN formed between the extended nip roll 12 and the counter roll 13. It should be understood that, in the embodiment of FIG. 1, the felt 7 moves "clockwise" as it runs in its loop. In the dewatering nip PN, water is pressed out of the paper web such that the dryness level of the web W increases. Under favorable conditions, the dryness level of the web may exceed 50% after the dewatering nip PN. When the running paper web W exits from the press nip PN the paper web leaves the felt 7 and will instead be guided by the extended nip roll 12. More precisely, the paper web W follows the outer surface of the flexible jacket 17 of the extended nip roll 12. The paper web follows the outer surface of the flexible jacket 17 to the transfer nip TN where the running paper web W is transferred from the extended nip roll 12 to the heat roll (drying cylinder) 14. When entering the press nip PN the paper web W gets into contact with the textured portion 15 provided on the external surface of the flexible jacket 17 of the extended nip roll 12 and this is the starting point for the formation of a three-dimensional structure of the paper web W. In the second nip, the transfer nip TN, the three-dimensional structure of the paper web W will be further improved by means of the textured portion 15 on the external surface of the flexible jacket 17 and when the paper web is transferred from the extended nip roll to the heat roll 14, the paper web has received its final three-dimensional structure. The heat roll 14 is normally a drying cylinder such as a Yankee drying cylinder. The heat roll 14 has a smooth outer which causes the web to be transferred from the outer surface of the flexible jacket 17 to the outer surface of the heat roll 14 (the web follows the smoothest surface and the surface of the heat roll is smoother than the surface of the flexible jacket 17). On the heat roll 14, water in the web is evaporated by heat such that the paper web is dried to a high dryness level. As the web follows the smooth outer surface of the heat roll 14, the paper web is brought to the doctor blade 27 where it is creped by the doctor blade 27 from the surface of the heat roll. The paper web may then be passed to a reel-up. It is to be understood that when the paper making process is completed, i.e. after the drying process, the produced paper may in some after-treatment process be further provided with additional structure.

In all embodiments, a suitable machine speed may be up to 2200 m/minute. For example, machine speed may be in the range of 1000 m/minute-2200 m/minute. Suitable speeds would normally be about 1500 m/minute-2200 m/minute to give the web a suitable dwell time for dewatering in the nip in combination with the need to keep up a production output. However, for reasons of productivity, it may be desirable to run the machine at even higher speeds. Generally speaking, the trend is that the technical development in the field of paper making machines results in ever increasing machine speeds. Therefore, it is conceivable that the inventive machine concept could one day be used at speeds of, for example, 2500 m/minute, 3000 m/minute or even higher speeds.

In many practical embodiments, the machine width may be in the range of 2-8 meters. For example, machine width may be 3.5-7 meters. However, machines wider than 8 meters are conceivable (for example machines up to a width of 10 meters or more). Machines narrower than 2 meters may also be considered. The pulp used in the process may be, for example, chemical pulp. Depending on the end user's needs, virgin pulp or recycled may be used. For paper products intended to be used in contact with human skin or in the kitchen, virgin pulp is preferred. Virgin pulp used in connection with the present invention may be based on hardwood, softwood or a mixture of hardwood and softwood fibers. Hardwood fibers used for the pulp may comprise, for example, Eucalyptus fibers or Acacia fibers or a mixture thereof.

Downstream of the drying cylinder, a reel-up may typically be arranged. The reel-up may be of any known kind, for example of the kind shown in U.S. Pat. Nos. 5,901,918 or 5,875,990.

In the area between the drying cylinder and the reel-up, the inventive machine may optionally be provided with an arrangement for collecting dust, for example according to U.S. Pat. No. 6,176,898. In the area between the drying cylinder and the reel-up, the inventive machine may optionally also be provided with means for supporting the web, for example as disclosed in U.S. Pat. No. 5,738,760.

When a Yankee dryer is used, it may optionally be provided with a Yankee hood such as the Advantage™ AirCap™ Yankee hood provided by Metso Paper.

Optionally, a steam box 28 may be arranged adjacent the felt 7 at a point upstream of the extended nip roll 12 as shown in FIG. 1. By using the steam box 28, dewatering of the paper web already before it reaches the heat roll 14 can be improved and dryness levels of up to 55% by weight or even higher may be achieved before the paper web has even reached the heat roll 14.

The surface temperature of the heat roll may vary depending on different requirements and operating conditions but, in many realistic embodiments, the surface temperature of the heat roll 14 may be in the range of 85° C.-125° C. or 90° C.-110° C. For example, it may be in the range of 90° C.-100° C. The inventive method may thus be described as including the step of heating the heat roll 14, preferably to such an extent that the surface temperature of the heat roll 14 reaches a level in the range of 85° C.-125° C.

Even though the invention has been described above in terms of a paper making machine, a method of producing tissue paper and an extended nip roll, it should be understood that these terms only reflect different aspects of one and the same invention. The inventive extended nip roll is thus used in the inventive machine and in the inventive method. The method may thus include such steps that would be the inevitable consequence of using (operating) the machine and the extended nip roll, regardless of whether such steps have been explicitly mentioned or not.

Although the invention has been described above as comprising a flexible jacket with an external surface which is provided with a textured portion, a machine and a method are conceivable in which the extended nip roll has a flexible jacket in which the external surface (i.e. the web-contacting surface) does not have a textured portion but is smooth. If the external surface is smooth instead of textured, the flexible belt would not give the paper web a three-dimensional structure. However, such a machine and method may still be advantageous since the flexible jacket can transfer the paper web effectively to the heat roll. The extended nip roll 12 may have a flexible jacket 17 with a smooth external surface. The flexible jacket 17 may be elastically compressible to some extent which allows the jacket to be compressed as is passes through a nip and then increase its thickness again after passage of the nip. Such a machine, which uses an extended nip roll with a flexible belt 17 that has a smooth external surface, may otherwise be identical to the machine described above that uses a flexible belt with a textured external surface.

The invention claimed is:

1. A paper making machine (1) for making tissue paper, the machine comprising:

a heat roll (14) arranged to dry a wet paper web; and an extended nip roll (12) configured to form a transfer nip (TN) with said heat roll (14), said extended nip roll (12) having a flexible jacket (17) arranged around the circumferential area of said extended nip roll (12) and forming a loop around at least one support body (18, 19), wherein an external surface of said flexible jacket (17) is provided with a textured portion (15) such that, when the wet paper web passes the transfer nip between said extended nip roll (12) and said heat roll (14), said textured portion (15) of the external surface of the flexible jacket (17) will impart a three-dimensional texture to said paper web.

2. A paper making machine according to claim 1, wherein:

said textured portion (15) extends along substantially the whole length of said flexible jacket (17) in a cross-machine direction; and said textured portion (15) covers substantially the whole of the external surface of the extended nip roll (12).

3. A paper making machine according to claim 1, wherein a cleaning device (16) is configured to clean the textured portion (15).

4. Paper making machine according to claim 1, wherein:

the at least one support body (18) is a flexible support body (18); and the flexible support body (18) at least one of comprises or is supported by at least one flexible hose that extends in a cross machine direction and is connected to a source of pressurized fluid such that pressurization of the at least one flexible hose will cause the flexible support body (18) to at least one of expand or move radially outwards.

5. A paper making machine according to claim 4, wherein said at least one support body (18, 19) is a flexible support body (18) comprising an internal cavity that can be pressurized internally by means of a pressurized fluid.

6. Paper making machine according to claim 1, wherein said support body (18) is a shoe with a concave surface, said concave surface faces outwards such that it can cooperate with the convex surface of said heat roll (14).

7. A paper making machine according to claim 1 wherein the machine further comprises:

a former (2) in which wet paper web may be formed, the former (2) having a forming roll (4);

a forming fabric (5) and a felt (7);

a counter roll (13) for the extended nip roll (12), said roll (13) being configured to form a dewatering nip (PN) with the extended nip roll (12) and the felt (7) being configured to pass through the dewatering nip (PN), the dewatering nip (PN) being arranged upstream of the transfer nip (TN) in the machine direction.

8. Paper making machine according to claim 7, wherein, within the loop of the flexible jacket (17), the extended nip roll (12) also comprises a second support body (19) that is placed opposite the counter roll (13) for the extended nip roll (12) to cooperate with the counter roll (13) for the extended nip roll (13) to form the dewatering nip (PN); and wherein said support body (19) is a flexible support body (19) or a concave shoe (18).

9. Paper making machine according to claim 7, wherein the counter roll for the extended nip roll (13) is a grooved roll.

10. Paper making machine according to claim 7, wherein the transfer nip has a length in the range of 30 mm-100 mm.

11. Paper making machine according to claim 1, wherein the textured portion is an integral part of the external surface flexible jacket.

12. Paper making machine according to claim 1, wherein said textured portion (15) extends along substantially the whole length of said flexible jacket (17) in a cross-machine direction.

* * * * *